United States Patent [19]

Wong

[11] Patent Number: 4,461,624

[45] Date of Patent: Jul. 24, 1984

[54] BENEFICIATION OF LOW-RANK COALS BY IMMERSION IN RESIDUUM

[75] Inventor: Brian Y. Wong, Mississauga, Canada

[73] Assignee: Gulf Canada Limited, Toronto, Canada

[21] Appl. No.: 470,106

[22] Filed: Feb. 28, 1983

[51] Int. Cl.[3] ..... C10L 5/16; C10L 9/00; F26B 3/00

[52] U.S. Cl. ..... 44/6; 44/1 R; 44/1 C; 208/8 LE; 34/9

[58] Field of Search ..... 44/6, 1 R, 1 C; 208/8 LE, 8 R, 22, 23, 39, 44, 4, 5, 6; 34/9

[56] References Cited

U.S. PATENT DOCUMENTS

| | | | |
|---|---|---|---|
| 1,808,340 | 6/1931 | Botch | 44/6 |
| 1,912,697 | 6/1933 | Fife | 44/6 |
| 3,961,914 | 6/1976 | Kindig et al. | 44/1 |
| 3,985,516 | 10/1976 | Johnson et al. | 44/1 |
| 4,192,650 | 3/1980 | Seitzer | 44/1 |
| 4,214,875 | 7/1980 | Kromrey | 44/6 |

FOREIGN PATENT DOCUMENTS

| | | | |
|---|---|---|---|
| 959783 | 12/1974 | Canada | 196/5 |
| 1195 | of 1888 | United Kingdom | 44/6 |
| 352542 | 7/1931 | United Kingdom | 44/6 |
| 832631 | 4/1960 | United Kingdom | 44/6 |

*Primary Examiner*—Delbert E. Gantz
*Assistant Examiner*—Chung K. Pak
*Attorney, Agent, or Firm*—R. H. Saunders

[57] ABSTRACT

A method of improving the calorific value and preventing autogenous heating of low-rank coals is disclosed which comprises crushing the coal into a particle size range from 0.1 cm to 3 cm, immersing the particles in a distillation residuum of petroleum crude oil at a temperature between 240° C. and decomposition temperature of the coal, and draining excess residuum from the particles to give a product preferably containing 2% to 15% by weight of the residuum. Some suitable residua are the vacuum residuum of a hydrogen donor-refined Athabasca bitumen and low-penetration asphalt. The residuum coating material must have a softening point of at least 80° C. The decomposition temperature is defined as the temperature for a particular coal at which its rate of weight loss upon heating first reaches a maximum value, and is in the range of 340° C. to 350° C. for most low-rank coals.

20 Claims, No Drawings

BENEFICIATION OF LOW-RANK COALS BY IMMERSION IN RESIDUUM

This invention relates to the beneficiation of low-rank coals by a simultaneous thermal treating and surface modifying process to improve their calorific value and to prevent autogenous heating. More particularly, it relates to a process wherein low-rank coals are immersed in a heated residuum of crude oil having a softening point above 80° C., which residuum forms a hard coating on the particles at ambient temperature.

The most abundant coal resource in western North America are the low rank coals, including sub-bituminous and lignite. Many deposits of these coals are relatively inexpensive to mine compared to higher-rank coals in eastern North America, but their economic value is reduced because they contain large amounts of oxygen in combined form and moisture. These compounds are non-combustible and merely add to the weight of the coal, increasing transportation costs significantly. A more dangerous problem with low-rank coals is that they can undergo autogenous heating, especially when wetted by rain or by being placed on wet ground; this sometimes leads to spontaneous combustion. Furthermore, the poor characteristics of low rank coals results in a derating of some boilers that have been designed specifically for better-burning coals.

The moisture content of low-rank coals can be decreased by drying the coal in a hot inert gas. However, the product can still reabsorb moisture under wet conditions, and be heated up to a temperature at which spontaneous combustion occurs by the combined heats of absorption of the moisture and oxidation of material in the coal. In U.S. Pat. No. 4,192,650, Seitzer disclosed the prevention of such autogenous heating by rehydrating the dried coal with steam at 100° C. to 115° C. to yield a moisture content of 2% to 10%. Kindig et al, in U.S. Pat. No. 3,961,914, disclosed coating dried coal particles with silicon dioxide by introducing silicon tetrachloride gas and reacting it with water to produce a silicon dioxide film on the surface of the coal. Johnson et al, in U.S. Pat. No. 3,985,516, disclosed the coating of sub-bituminous and lignite coal particles with crude oil residuum after drying. The residuum could advantageously be diluted with a lighter oil to improve the uniformity of the coating. Kromrey disclosed in U.S. Pat. No. 4,214,875 a coating composition to be applied to a pile of coal exposed to the weather in order to exclude rain and air by forming a continuous covering over the entire pile. The composition was normally thixothropic and included wax, tar or pitch or a polymer which provided a covering from one-quarter inch to one inch thick. It was necessary to break the covering in order to transfer or utilize the coal. Berkowitz, in Canadian Pat. No. 959,783, described a method of treating low-rank coals which included heating the coal to a temperature above the decomposition temperature by immersion in a liquid medium. At and above the decomposition temperature, pyrolytic material began to diffuse out from the interior to the surface of the coal particles and plugged the fine pores of low rank coals to exclude moisture reabsorption.

The aforementioned problems have been overcome by the present invention, which provides a method of improving the calorific value of low-rank coal comprising immersing said coal in a distillation residuum of petroleum crude oil, said residuum being at a temperature between substantially 240° C. and the decomposition temperature of the coal, said decomposition temperature being defined as the temperature for a particular coal at which its rate of weight loss upon heating first reaches a maximum value, said residuum having a softening point of at least substantially 80° C.

The present invention also provides a method of improving the calorific value of low-rank coals further comprising, after the immersion step, allowing excess residuum to drain from said coal to yield a beneficiated coal product containing a coating of said residuum comprising from 2% to 15% by weight of said coal product.

The present invention also consists in a beneficiated particulate coal product of improved calorific value comprising low-rank coal and a residuum coating having a softening point of at least substantially 80° C., said residuum coating being applied by immersing said coal in said residuum heated to a temperature between substantially 240° C. and the decomposition temperature of the coal, said decomposition temperature being defined as the temperature for a particular coal at which its rate of weight loss upon heating first reaches a maximum value.

Low rank, high moisture content coals can be beneficiated by the process of the invention, for example sub-bituminous and lignitic coals. As mined, these coals have moisture contents of up to 25% or more. The process can also be used with low-rank coals that have undergone drying, for example air drying to equilibrium, or even with fully dried coals.

The residuum can be any atmospheric or vacuum residuum, for example tar, pitch or asphalt, made from conventional or heavy crude oils or from tar sands bitumen. Also suitable are the vacuum residua of upgraded heavy crudes and bitumens, the upgrading being done, for example, by hydrocracking with hydrogen or hydrogen donor material. Asphalt or oxidized asphalt can also advantageously be used as the immersion medium, as can mixtures of any of the aforementioned residua. Suitable immersion media must, however, have a softening point of at least 80° C., and preferably at least 85° C., because the residuum is not washed off the coal particles in the process of the invention, and thus a coating of residuum remains on the surface of the particles. During transportation and outdoor storage, coal can under bright sunlight reach temperatures in the range of 70° C. to 80° C.; the coating materials of the invention remain non-tacky at those temperatures and impede agglomeration of the coated coal particles. Because tackiness is inversely correlated with softening point, and tackiness measurements are not common in the coal industry, softening point is used in this specification as a measure of suitability of a residuum for coating coal particles.

As the coal particles are heated in the immersion step, water in the coal is evaporated to steam and driven off the particles. Thus no separate drying step is necessary to remove the moisture from the coal particles prior to applying the coating material. The minimum temperature of the residuum at the time of immersion is about 240° C.; lower temperatures render the residuum too viscous to apply the required thin coating. The maximum temperature of the residuum at the time of immersion of the coal particles is the decomposition temperature of the coal. The decomposition temperature is defined as the temperature at which the rate of weight loss of the coal first reaches a maximum value when the coal is heated in an inert atmosphere. For many Western sub-bituminous coals and lignites, the decomposition temperature is in the range of 340° C. to 350° C. A preferred temperature of heating is about 290° C. to about the decomposition temperature, and a most preferred temperature range is from about 320° C. to 340° C. Degradation of the coal particle size and loss of combustible volatile constituents of the coal during immersion also become unacceptably high above the decomposition temperature of the coal. Oxygen occurs substantially entirely in combined form in low-rank coals, principally in carboxylic, phenolic and ether forms. Carboxylic oxygen is both abundant and less thermally stable than the other forms of oxygen in low rank coals, and is reduced more readily than the phenolic and etheric oxygen.

The immersion time can be from about 5 minutes to 60 minutes, preferably from 5 minutes to 30 minutes. The coal particle size can be from about 0.1 cm, i.e. No. 18 screen, to about 3 cm. Preferably, the coal particles are in the size range from 0.5 cm to 2 cm.

Optionally, the method includes the further step of allowing excess hot residuum to drain from the coal particles to yield a beneficiated coal product with a residuum coating which comprises from 2% to 15% by mass of the product. The draining can be accomplished by well-known methods, for example placing the coated coal particles on a heated screen which is retentive of the desired size of coal particles, but which allows the hot residuum to drip through. The proportion of residuum coating can be controlled by adjusting the draining conditions, particularly the draining time, the temperature of the hot screen and the amount of cooling provided by the surrounding gaseous medium. The medium is usually air, which does not oxidize the coal product significantly during the draining step. The maximum proportion of residuum coating on the product coal particles is about 15% by mass of product. The maximum proportion of residuum coating allowable commercially is influenced by, among other factors, the allowable sulphur content of the finished product when it is to be burned in steam boilers. The typical sulphur content of most petroleum residua is greater than the typical sulphur content of western low-rank coals, and thus it can be seen that a limited sulphur content in the beneficiated coal product dictates a limited residuum coating content. For example, a 0.3%-sulphur coal with a coating of 6%-sulphur residuum amount to 7% by mass on the beneficiated coal particles has a final overall sulphur content of about 0.7% which is acceptable under most existing sulphur emission regulations. A preferred coating proportion is from 5% to 7% by mass.

The invention will be further described by the following examples, which illustrate preferred embodiments of the invention.

EXAMPLES I–II

Samples of Wabamun coal, a sub-bituminous coal originating from Alberta province were classified into size ranges of 2.4 mm to 6.3 mm and 6.3 mm to 9.5 mm. The as-received samples had been partially dried, having a moisture content of 9.0%. Aliquots of approximately 100 grams were placed in a dip bucket made from No. 40 screening material and inserted into a 2-liter beaker approximately two-thirds full of heated DRB vacuum residuum. This material was obtained from the upgrading of the vacuum residuum of heavy oil from the Pelican field in Alberta by the Donor Refined Bitumen (DRB) process described in Canadian Pat. No. 1,122,914, issued on May 4, 1982. The DRB vacuum residuum had a softening point of 91° C., zero penetration at 25° C. and a viscosity of 3,000 centistokes at 150° C. The time and temperature of immersion were as indicated in Table 1. After removal from the beaker, the coal product in the dip bucket was allowed to drain for about 10 minutes in the hot air above the beaker, and then to cool to ambient temperature, and the beneficiated coal particles were poured into product bottles for testing.

Test procedures throughout were the applicable A.S.T.M. methods except for the equilibrium moisture determination; because the coating on the product coal particles would be broken by crushing, a modified ASTM D1412-74 test method was used wherein the particles were tested directly without crushing. For consistency, the same method was used to measure equilibrium moisture of the raw coals.

EXAMPLE III

A similar process to that described in Examples I and II was carried out using a 40-gram sample of partially dried sub-bituminous coal from the Atlas mine in the Drumheller area of Alberta province, having a particle size from 2.4 mm to 6.3 mm; the results are described in Table 1.

EXAMPLES IV AND V

Samples of the Wabamun coal described above were immersed in 210 grade asphalt, a material having a softening point of 101° C., a penetration of $9\times10^{-4}$ m at 25° C. and a viscosity of 1875 centistokes at 177° C., with results described in Table 2.

TABLE 1

BENEFICIATION OF LOW-RANK COALS

| | EXAMPLES | | |
|---|---|---|---|
| | I | II | III |
| Coal Type | Wabamun | Wabamun | Atlas |
| Particle mm | 2.4–6.3 | 2.4–6.3 | 2.4–6.3 |
| Residuum Type | DRB Vac. | DRB Vac. | DRB Vac. |
| Residuum Softening Point | 91° C. | 91° C. | 91° C. |
| Residuum Sulphur Content | 7.0% | 7.0% | 7.0% |
| Temperature | 315° C. | 330° C. | 330° C. |
| Immersion Time, min. | 30 | 30 | 15 |
| Raw Coal Properties | 23.2 | 23.2 | 22.4 |
| Calorific Value, Joules/kg $\times 10^6$ | | | |
| Actual Moisture Content | 9.0% | 9.0% | 14.9 |
| Equilibrium Moisture | 13.9% | 13.9% | 16.8% |
| Sulphur Content | 0.14% | 0.14% | 0.43% |
| Product Properties | 27.5 | 27.8 | 27.5 |
| Calorific Value, Joules/kg $\times 10^6$ | | | |
| Actual Moisture Content | 0% | 0.31% | 0% |
| Equilibrium Moisture | 8.6% | 7.4% | 8.1% |
| Sulphur Content | 1.0% | 0.79% | 1.0% |
| Residuum Content | 10.4% | 8.1% | 7.1% |

EXAMPLE VI

High-moisture samples of Wabamun coal were prepared by immersing samples of the raw material of Example V in distilled water for 72 hours and drying for 20 minutes to remove surface moisture. The resulting moisture content was 20.9%. The particles were treated similarly to those in Example II and after treatment, the beneficiated coal showed a moisture content of 0% and a coating weight of 8.4% by mass based on the finished product. Specific conditions of treatment and results are shown in Table 2.

TABLE 2

BENEFICIATION OF LOW-RANK COALS

| | EXAMPLES | | |
|---|---|---|---|
| | IV | V | VI |
| Coal Type | Wabamun | Wabamun | Wabamun |
| Particle Size, mm | 2.4–6.3 | 6.3–9.5 | 6.3–9.5 |
| Residuum Type | 210 Asphalt | 210 Asphalt | DRB Vac. |
| Residuum Softening Point | 101° C. | 101° C. | 91° C. |
| Residuum Sulphur Content | 4.0% | 4.0% | 7.0% |
| Temperature | 320° C. | 320° C. | 330° C. |
| Immersion Time, min. | 30 | 30 | 30 |
| Raw Coal Properties | 23.2 | 23.1 | 20.3 |
| Calorific Value, Joules/kg × $10^6$ | | | |
| Actual Moisture Content | 9.0% | 9.0% | 20.9% |
| Equilibrium Moisture | 13.9% | 13.9% | 13.9% |
| Sulphur Content | 0.14% | 0.14% | 0.12% |
| Product Properties | 27.6 | 28.3 | 28.9 |
| Calorific Value, Joules/kg × $10^6$ | | | |
| Actual Moisture Content | 0% | 0% | 0% |
| Equilibrium Moisture | 4.4% | 3.3% | 7.6% |
| Sulphur Content | 0.52% | 0.45% | 0.90% |
| Residuum Content | 8.4% | 7.4% | 8.4% |

COMPARISON TEST

For comparison, a sample of Wabamun coal having a particle size from 6.3 mm to 9.5 mm was treated by the method of Example I by immersion in propane-precipitated asphalt residuum at a temperature of 330° C. for 15 minutes. The asphalt residuum, which was made from a standard mix of Interprovincial Pipeline crudes, had a softening point of 74° C., a viscosity of 851 centistokes at 150° C. and a penetration of $3\times10^{-4}$ m at 25° C. After immersion and draining, the coated coal particles were sticky and tended to agglomerate, being physically unsuited to normal transportation and storage procedures. It was clear that the softening point of this residuum was below the required range.

The beneficiated coal product in all Examples equalled or exceeded the calorific value of a typical bituminous coal, which is about $26.3\times10^6$ Joules/kg. After cooling in the dip bucket, the particles of beneficiated coal product prepared by the method of the invention exhibited a slight adhesion to each other caused by their being in contact during cooling, but a light tap on the bucket was sufficient to break up the mass of particles, which remained pourable thereafter and exhibited a hard, glossy surface.

Roughly correlated to a coal's equilibrium moisture content is its propensity towards autogenous heating and hence, spontaneous combustion. An advantage of the process of the invention is that the significantly lowered equilibrium moisture content of the coal product of the invention, as compared to the raw material, is indicative of a much lower tendency to undergo autogenous heating and consequent spontaneous combustion. The process of the invention has the significant advantage that it can use a residuum which is otherwise of low economic value and which is expected to be in surplus in the future. The immersion media of the invention, being distillation residua, have very low volatility and thus unlike light oil coatings they are not subject to evaporation losses during product transport and storage. The method of the invention produces a beneficiated coal product with a heating value equivalent to most bituminous coals because of reduced water and oxygen content. Because of its high calorific value, the beneficiated coal produced by the method of the invention will produce a required thermal output in a furnace with significantly less transportation cost where the furnace is located at a site remote from the coal mine.

What is claimed is:

1. A method of improving the calorific value of low-rank coal comprising immersing said coal in a distillation residuum of petroleum crude oil, said residuum being at a temperature between substantially 240° C. and the decomposition temperature of the coal, said decomposition temperature being defined as the temperature for a particular coal at which its rate of weight loss upon heating first reaches a maximum value, said residuum having a softening point of at least substantially 80° C.

2. A method as claimed in claim 1, wherein the coal is in particulate form having a size range from substantially 0.1 cm to substantially 3 cm.

3. A method as claimed in claim 1, wherein said residuum comprises vacuum residuum derived from heavy oil or bitumen.

4. A method as claimed in claim 3, wherein said residuum comprises vacuum residuum derived from upgraded heavy oil or bitumen, said upgrading being done by hydrogen donor hydrocracking.

5. A method as claimed in claim 1, wherein said residuum comprises asphalt or oxidized asphalt.

6. A method as claimed in claim 1, further comprising allowing excess residuum to drain from said coal to yield a beneficiated coal product containing a coating of said residuum comprising from substantially 2% to substantially 15% by mass of said coal product.

7. A method as claimed in claim 6, wherein said residuum coating comprises 5% to 7% of said coal product.

8. A method as claimed in claim 1, wherein said temperature is from substantially 290° C. to the decomposition temperature of said coal.

9. A method as claimed in claim 1, wherein said temperature is from substantially 320° C. to 340° C.

10. A method as claimed in claim 1, wherein the duration of said immersion step is from substantially 5 to substantially 30 minutes.

11. A method as claimed in claim 1 wherein said residuum has a softening point of at least 85° C.

12. A beneficiated particulate coal product of improved calorific value comprising low-rank coal and a residuum coating having a softening point of at least substantially 80° C., said residuum coating being applied by immersing said coal in said residuum heated to a temperature between substantially 240° C. and the decomposition temperature of the coal, said decomposition temperature being defined as the temperature for a particular coal at which its rate of weight loss upon heating first reaches a maximum value.

13. A beneficiated coal product as claimed in claim 12 comprising particles sized from substantially 0.1 cm to substantially 3 cm.

14. A beneficiated coal product as claimed in claim 12 comprising substantially 2% to substantially 15% of said residuum.

15. A beneficiated coal product as claimed in claim 12 wherein said residuum comprises asphalt or oxidized asphalt.

16. A beneficiated coal product as claimed in claim 12 wherein said residuum comprises vacuum residuum derived from upgraded heavy oil or bitumen, said upgrading being done by hydrogen donor hydrocracking.

17. A beneficiated coal product as claimed in claim 12 wherein the softening point of said residuum coating is at least 85° C.

18. A method as claimed in claim 1 further comprising prior to immersion, the step of reducing the moisture content of said low-rank coal by drying means.

19. A method as claimed in claim 1 wherein said low-rank coal has a moisture content of at least 9%.

20. A method of improving the calorific value of low-rank coal consisting essentially of:

(a) immersing said coal in a distillation residuum of petroleum crude oil, said residuum being at a temperature between substantially 240° C. and the decomposition temperature of the coal, said residuum having a softening point of at least substantially 80° C.;

(b) allowing excess residuum to drain from said coal to yield a beneficiated coal product containing a coating of said residuum comprising from substantially 2% to substantially 15% by mass of said product.

* * * * *